US005981889A

United States Patent [19]

Niklaus

[11] Patent Number: 5,981,889

[45] Date of Patent: Nov. 9, 1999

[54] SPRING DRIVE MECHANISM FOR SWITCH GEAR, IN PARTICULAR A CIRCUIT BREAKER

[75] Inventor: Rolf Niklaus, Unterentfelden, Switzerland

[73] Assignee: Gec Alsthom T & D AG, Oberentfelden, Switzerland

[21] Appl. No.: 09/083,239

[22] Filed: May 22, 1998

[30] Foreign Application Priority Data

May 26, 1997 [FR] France ..... 97 06371

[51] Int. Cl.[6] ..... H01H 3/40

[52] U.S. Cl. ..... 200/501; 200/400; 218/154

[58] Field of Search ..... 74/567, 569; 200/17 R, 200/401, 501, 573, 574, 337, 400; 218/7, 14, 78, 84, 92, 120, 140, 153, 154

[56] References Cited

U.S. PATENT DOCUMENTS

| | | | |
|---|---|---|---|
| 4,095,676 | 6/1978 | Howe et al. | 185/40 R |
| 4,681,993 | 7/1987 | Kondo et al. | 200/153 SC |
| 5,113,056 | 5/1992 | Kuhn | 200/400 |
| 5,541,378 | 7/1996 | Niklaus | 200/400 |

FOREIGN PATENT DOCUMENTS

| | | | |
|---|---|---|---|
| 0294561A2 | 12/1988 | European Pat. Off. | H01H 3/30 |
| 0651409A1 | 5/1995 | European Pat. Off. | H01H 3/30 |

*Primary Examiner*—Michael Friedhofer

*Attorney, Agent, or Firm*—Sughrue, Mion, Zinn, Macpeak & Seas, PLLC

[57] ABSTRACT

A spring drive mechanism for power switch gear. The mechanism includes an engagement shaft free to rotate about its own axis and carrying both a large toothed wheel and a cam. An engagement spring constituted by a traction spring is coupled to the large toothed wheel at an attachment point by a chain. The large toothed wheel meshes with a small toothed wheel which is coupled via a gear train to a driving gearwheel secured to an outlet shaft of a drive motor. In the predetermined direction A of rotation, the large toothed wheel includes a discontinuity in its teeth, thereby generating a gap which constitutes a zone without teeth, and in which a retractable tooth is disposed. Following the retractable tooth, the large toothed wheel has an additional discontinuity in its teeth over at least two meshing steps. This mechanism is advantageous as switchgear for a circuit breaker.

13 Claims, 3 Drawing Sheets

SPRING DRIVE MECHANISM FOR SWITCH GEAR, IN PARTICULAR A CIRCUIT BREAKER

FIELD OF THE INVENTION

The present invention relates to a spring drive mechanism for power switchgear, in particular a power switch for medium and high voltage, in particular a circuit breaker, said mechanism comprising:

an engagement spring eccentrically coupled to an engagement shaft that is free to rotate about its axis, said spring being organized to put the switchgear into circuit by driving, in a predetermined direction of rotation, both the engagement shaft and a large toothed wheel mounted on the engagement shaft together with a small toothed wheel which meshes with said large toothed wheel and which is coupled to a drive member for putting the engagement spring under stress so that it can put the switchgear into circuit, said drive member operating by driving said engagement shaft and said large toothed wheel via said small toothed wheel in said predetermined direction, said engagement shaft being organized to pass from a position in which the engagement spring is at least partially relaxed, to beyond a dead-center position in which the engagement spring is under stress;

a pawl mechanism organized to bear against the large toothed wheel in a bearing position situated beyond the dead-center position in said predetermined direction and to release said engagement shaft to put the switchgear into circuit;

a gap formed in the periphery of said large toothed wheel and generated by a discontinuity in the teeth of said large toothed wheel, said gap being provided in a zone of the teeth which is situated close to said small toothed wheel when said engagement shaft is bearing against the pawl mechanism; and means for preventing mutual jamming between the large toothed wheel and the small toothed wheel after the engagement shaft has been released by the pawl mechanism, said means comprising:

a shape for the teeth of said small toothed wheel having flanks that meet radially outwards on a common edge and presenting, on the leading flank, an involute shape and on the opposite flank, a flank plane extending from the edge and sloping relative to a radial straight line passing through the middle of the tooth; and a shape for the tooth of the large toothed wheel that follows the gap in said predetermined direction, its flanks meeting radially outwards at a common edge and including a sloping plane in its top zone adjacent to the edge.

BACKGROUND OF THE INVENTION

European patent application No. 0 651 409 A1 describes a mechanism of this type. In that embodiment, all of the teeth of the small toothed wheel and the first tooth following, in the predetermined direction, the gap formed by the discontinuity in the teeth of the large toothed wheel are shaped in such a manner that their flanks converge on respective single common edges. The purpose of that measure is to prevent the toothed wheels jamming. Nevertheless, it turns out that the friction between an edge of the small toothed wheel against the leading flank of the first tooth of the large tooth wheel immediately after the gap gives rise to a loss of power of greater or lesser extent due to friction. Such losses of power depend on the position of the small toothed wheel, and as a result they give rise to variations in the time taken to engage the switchgear as well as to non-negligible wear on the first tooth of the large toothed wheel immediately following the gap. If the mechanism is used for controlling a switch that is designed to be engaged to reduce surges on a network synchronously with the voltage of the network, then such variations appear in random manner and are not acceptable.

European patent No. 0 294 561 A2 describes a drive mechanism of similar type, coupled to a disconnector and having a first tooth of the large toothed wheel that is situated immediately following the gap which is radially retractable against the urging of a compression spring. If this tooth comes into abutment against the top of a tooth of the small toothed wheel at the beginning of the engagement process, then it retracts radially, compressing the spring with which it is associated. As a result, this tooth can slide over the edge of the corresponding tooth of the small toothed wheel without giving rise to jamming. After it has gone past the edge, it engages in the space following the tooth of the small toothed wheel. Nevertheless, there exists a large risk of the retractable tooth continuing to drive the large toothed wheel by friction, in spite of it being progressively retracted into the housing which contains the spring. Under such circumstances, the second tooth following the gap formed on the large toothed wheel, which second tooth is not retractable, can itself come into abutment against the edge of a tooth of the small toothed wheel and jam the entire mechanism. This probability is high, since the small toothed wheel is decoupled from its drive by a freewheel coupling and therefore can turn very easily.

OBJECTS AND SUMMARY OF THE INVENTION

The present invention seeks to remedy those drawbacks and to avoid any risk of faulty operation in such known mechanisms by providing a solution that is effective, simple to implement, and of low cost, which can also be fitted by appropriate modification to mechanisms of this type which are already in service.

This object is achieved by the mechanism as defined in the field of the invention, wherein said gap formed in the periphery of said large toothed wheel is followed, in said predetermined direction, by a tooth that is axially retractable against the stress of a compression spring, and wherein said retractable tooth is followed in said predetermined direction by an additional gap formed at the periphery of said large toothed wheel, and generated by an additional discontinuity in its teeth, said additional gap extending over at least two meshing steps.

In a preferred embodiment, the first tooth of the teeth of said large toothed wheel following the additional gap has a shape similar to the shape of the retractable tooth.

In a particularly advantageous embodiment, said additional gap extends over three meshing steps.

Preferably, said retractable tooth, when in the non-retracted state, stands proud relative to the other teeth of the large toothed wheel.

Finally, in an advantageous embodiment, which provides additional guarantees against the risk of the large toothed wheel and the small toothed wheel jamming, at least one additional tooth beyond said first tooth following the additional gap of said large toothed wheel is of a shape similar to that of the retractable tooth.

BRIEF DESCRIPTION OF THE DRAWINGS

The present invention will be better understood with reference to the description of a preferred embodiment and the corresponding drawings given by way of non-limiting example, and in which.

MORE DETAILED DESCRIPTION

Figure 1:
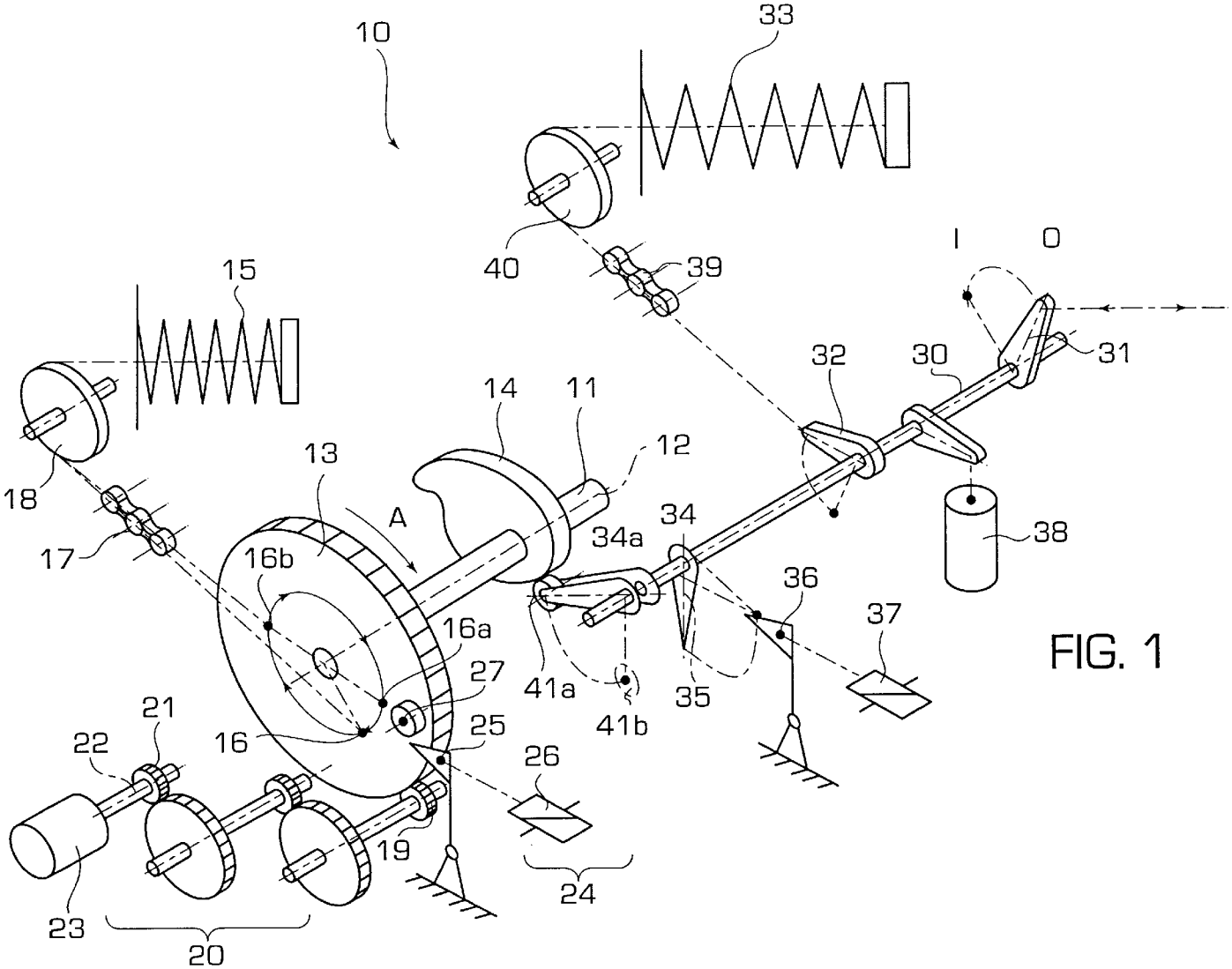
FIG. 1 is a diagrammatic overall view showing a preferred embodiment of the mechanism of the invention.

With reference to FIG. 1, the spring drive mechanism 10 as shown for coupling to switching gear includes an engagement shaft 11 which is free to rotate about its own axis 12 and which carries both a large toothed wheel 13 and a cam 14 whose function is explained below. An engagement spring 15 constituted by a traction spring is coupled to the large toothed wheel 13 at an attachment point 16 via a chain 17 or any other appropriate means, which passes over a deflector pulley 18 in the example shown. The large toothed wheel 13 meshes with a small toothed wheel 19 which is coupled via a gear train 20 to a driving gearwheel 21 secured to an outlet shaft 22 of a drive motor 23.

This set of mechanism components is known per se and is described in detail in European patent application No. 0 652 409 mentioned in the introduction, and it is designed so that the engagement spring 15 can drive the engagement shaft 11 in a determined direction of rotation A (see arrow A in FIG. 1) in order to put the switching apparatus (not shown) into circuit, and so that the drive motor 23 can put the engagement spring 15 under stress so that it is cocked, ready to release its accumulate energy at any instant to put the switching gear into circuit. To this end, while the apparatus is being engaged, the engagement spring 15 exerts traction on the chain 17 and causes the large toothed wheel 13 to rotate in the predetermined direction shown by arrow A, with the attachment point 16 passing from a ready position situated slightly downstream from the dead-center point 16*a* (downstream in the predetermined direction of rotation A of the large toothed wheel), to a final position corresponding to a relaxation point 16*b* which is diametrically opposite the dead-center point 16*a*. Thereafter, the drive motor 23 takes over to drive the engagement shaft 11, rotating it in the predetermined direction A. This displacement continues until the attachment point of the engagement spring has again gone a little way past the dead-center point 16*a*, at which point the spring is cocked. The large toothed wheel is stopped in this position by a pawl mechanism 24 which comprises a pawl 25 actuated by an electromagnet 26, and an abutment 27 mounted on one of the faces of the large toothed wheel 13 and which co-operates with the pawl 25 to stop the wheel in the desired ready position.

In addition, the mechanism 10 has a main shaft 30 which carries, in particular, a control lever 31 of a handle (not shown) of the switchgear, a lever 32 coupling said shaft to a trigger spring 33, a wheel-carrying lever 34 carrying a cam-follower wheel 34*a* which co-operates with the cam 14, a locking lever 35 which co-operates with a pawl 36 actuated by an electromagnet 37, and a brake lever which is coupled to a brake 38 constituted, for example, by a hydraulic actuator or the like. The trigger spring 33 is preferably identical or similar to the engagement spring 15 and it is connected to the coupling lever 32 by means of a chain 39 guided by a deflector pulley 40. The cam-follower wheel 34*a* is pressed against the cam 14 mounted on the engagement shaft 11. The cam moves the lever 34 between two positions 41*a* and 41*b* which correspond respectively to positions I and O of the control lever 31. The pawl 36 locks the locking lever 35 in a position which corresponds to the position I of the control lever 31.

Figure 2:
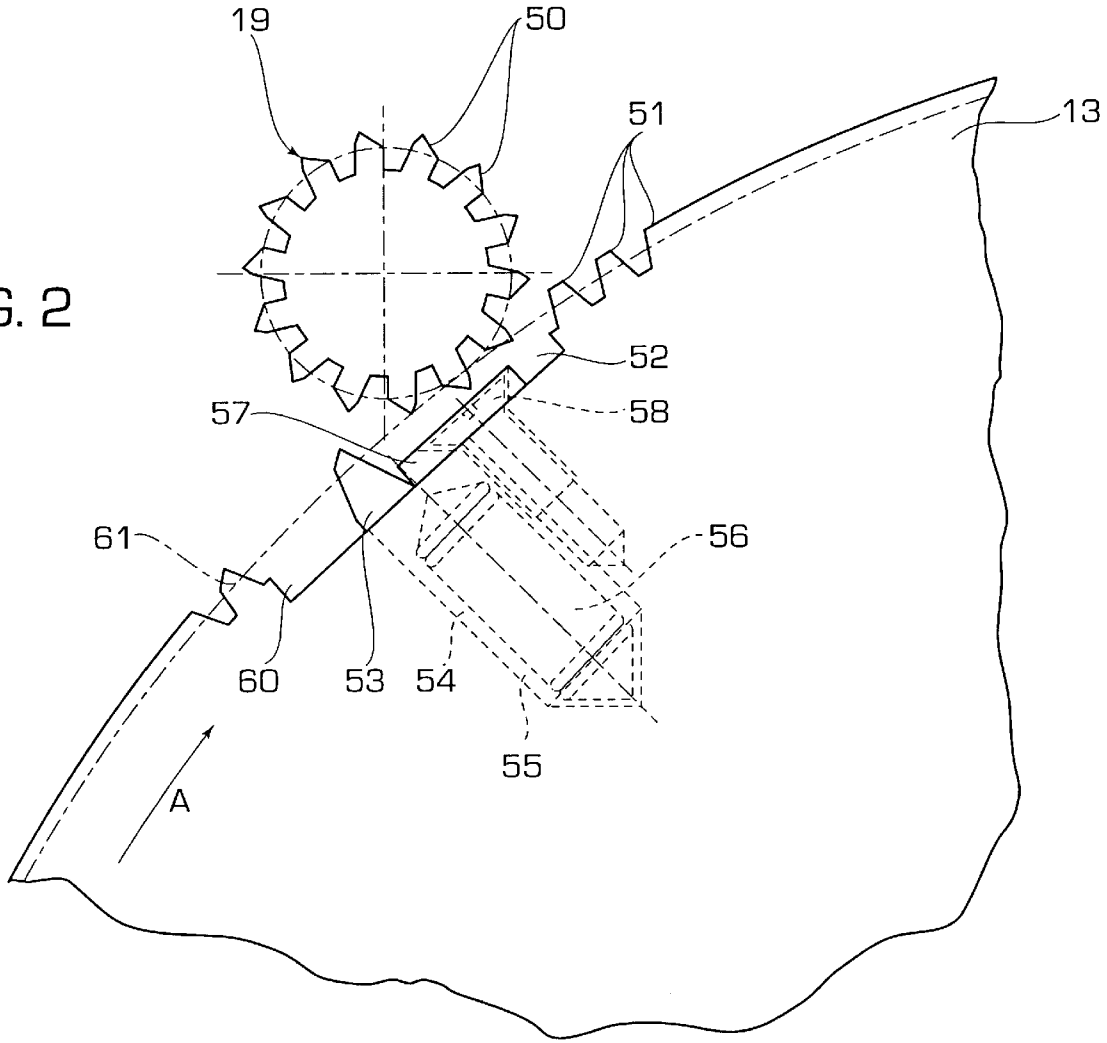
FIG. 2 is a detail view showing more specifically the retractable tooth of the large toothed wheel.

FIG. 2 is on a larger scale and shows a portion of the large toothed wheel 13 and of the small toothed wheel 19. It will be observed that the teeth of the small toothed wheel 19 are of a special shape, being cut to a point. The flanks of these teeth taper radially outwards to meet at a common edge, and the leading flank has an involute shape while the opposite flank is in the form of a plane sloping from the edge and inclined relative to a radial line passing through the middle of the corresponding tooth.

In the predetermined direction of rotation A, the large toothed wheel 13 has a discontinuity in its teeth 51, this discontinuity generating a gap 52 which constitutes a zone without teeth. A retractable tooth 53 is disposed in the gap. It is secured to a partially hollowed-out bush 54 which is received in a substantially cylindrical recess 55 formed in the thickness of the large toothed wheel. A compression spring 56 is mounted in the closed space defined between the cavity in the hollowed-out bush 54 and the recess 55 in the wheel, said spring tending to urge the tooth 53 radially out from the wheel. To prevent the tooth escaping and to limit its outward stroke, a stop plate 57 is fixed in the bottom of the gap 52 so as to obstruct the recess 55 in part. This stop plate is fixed by means of at least one, and preferably two locking screws 58. By means of this assembly, the tooth 53 can be retracted in part into the recess 55 against the stress exerted by the compression spring 56.

Following the retractable tooth 53, the large wheel 13 has an additional gap 60 generated by an additional discontinuity in the teeth 51 of the wheel. This gap extends over at least two meshing steps. In a preferred embodiment, this gap extends over three meshing steps.

The tooth 61 immediately following the additional gap 60 and constituting one of the teeth of the large toothed wheel is similar in shape to the retractable tooth 53. For these two teeth, at least, the flanks meet radially in an outward direction at a common edge. The flank opposite from the leading flank has a top portion adjacent to the edge of the tooth in the form of an inclined plane. In addition, the retractable tooth 53 projects proud relative to the other teeth 51 of the teeth of the large toothed wheel, which has the advantage of reducing the probability of its tip remaining in contact with the tip of a tooth of the small toothed wheel 19.

FIGS. 3A to 3D show what happens when the tip of a tooth 50 of the small toothed wheel 19 meets the tip of the retractable tooth 53 of the large toothed wheel 13. FIG. 3 shows the instant of initial contact between the two teeth 50 and 53.

Figure 3A:
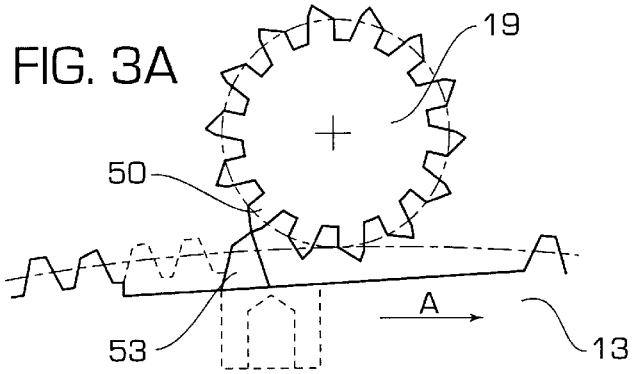
FIGS. 3A, 3B, 3C, and 3D show the movements of the large toothed wheel and of the small toothed wheel in the zone where the retractable tooth meshes with the teeth of the small toothed wheel.
Figure 3B:
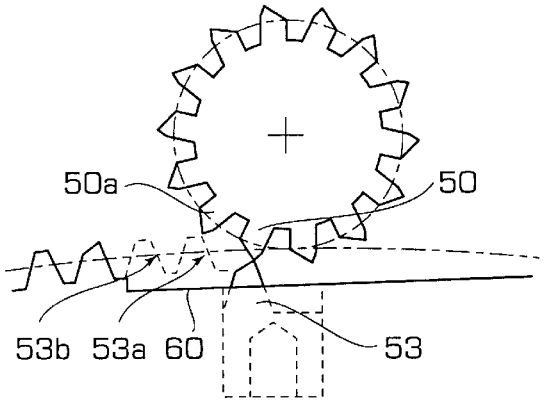

The retractable tooth 53 is retracted, as shown in FIG. 3B. Two teeth 53*a* and 53*b* are shown in dashed lines. These are the teeth that have been removed and replaced by said additional gap 60. It can be seen that if these two teeth had been left in place, then the risk of the following tooth 50*a* of the small toothed wheel 19 coming into contact with and jamming against the tooth 53*a* would be veery high. That is why the additional gap is provided and at least two teeth 53*a* and 53*b* are omitted. This additional gap completely eliminates any risk of the large toothed wheel jamming.

Figure 3C:
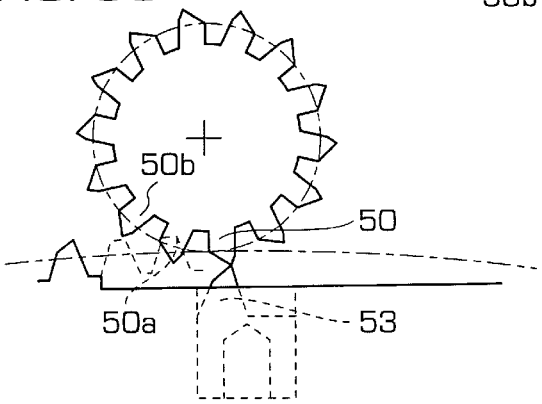

FIG. 3C shows how the teeth of the two toothed wheels behave. The teeth 50*a* and 50*b* following the tooth 50 of the small toothed wheel 19 occupy the additional gap zone 60 throughout the combined displacement of the teeth 50 and 53.

Figure 3D:
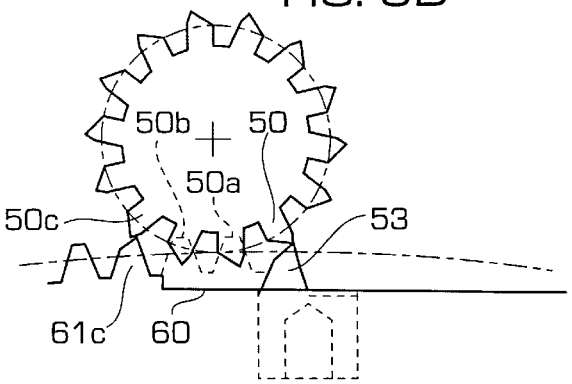

FIG. 3D shows the position of the tooth 50*c* which comes into contact with the tooth 61 which is the first tooth of the large toothed wheel 13 following the additional gap 60. It can be seen that the two teeth 50*c* and 61 cannot jam against each other because of their special shape.

The invention is not limited to the embodiments shown which merely constitute specific constructions.

I claim:

1. A spring drive mechanism for power switchgear, said mechanism comprising:

an engagement spring eccentrically coupled to an engagement shaft that is free to rotate about an axis, said spring adapted to put the switchgear into circuit by driving, in a predetermined direction of rotation, both the engagement shaft and a large toothed wheel mounted on the engagement shaft together with a small toothed wheel which meshes with said large toothed wheel and which is coupled to a drive member for putting the engagement spring under stress so that the engagement spring can put the switchgear into circuit, said drive member operating by driving said engagement shaft and said large toothed wheel via said small toothed wheel in said predetermined direction, said engagement shaft being adapted to pass from a position in which the engagement spring is at least partially relaxed to beyond a dead-center position in which the engagement spring is under stress, said large toothed wheel including a periphery and teeth, said small toothed wheel including teeth;

a pawl mechanism adapted to bear against the large toothed wheel in a bearing position situated beyond the dead-center position in said predetermined direction and to release said engagement shaft to put the switchgear into circuit;

a gap formed in the periphery of said large toothed wheel and generated by a discontinuity in the teeth of said large toothed wheel, said gap being provided in a zone of the teeth which is situated close to said small toothed wheel when said engagement shaft is bearing against the pawl mechanism; and means for preventing mutual jamming between the large toothed wheel and the small toothed wheel after the engagement shaft has been released by the pawl mechanism, said means comprising:

the teeth of said small toothed wheel, wherein each tooth is shaped to have flanks that meet radially outwards on a common edge and to present, on a leading flank, an involute shape and on an opposite flank, a flank plane extending from the common edge and sloping relative to a radial straight line passing through the middle of the tooth; and a retractable tooth on the large toothed wheel, said retractable tooth having a shape which includes flanks meeting radially outwards at a common edge and a sloping plane in a top zone adjacent to the common edge, said retractable tooth being axially retractable against a biasing force of a compression spring such that said retractable tooth is movable between a non-retracted state and a retracted state;

wherein said gap formed in the periphery of said large toothed wheel is followed, in said predetermined direction, by said retractable tooth, and wherein said retractable tooth is followed in said predetermined direction by an additional gap formed at the periphery of said large toothed wheel, and generated by an additional discontinuity in the teeth of said large toothed wheel, said additional gap extending over at least two meshing steps.

2. A mechanism according to claim 1, wherein a first tooth of the teeth of said large toothed wheel following the additional gap has a shape similar to that of the retractable tooth.

3. A mechanism according to claim 2, wherein at least one additional tooth beyond said first tooth following the additional gap of said large toothed wheel is of a shape similar to that of the retractable tooth.

4. A mechanism according to claim 1, wherein said additional gap extends over three meshing steps.

5. A mechanism according to claim 1, wherein said retractable tooth, when in the non-retracted state, stands proud relative to the teeth of the large toothed wheel other than said retractable tooth.

6. A spring drive mechanism for power switchgear, said mechanism comprising:

an engagement spring eccentrically coupled to an engagement shaft that is free to rotate about an axis, said spring adapted to put the switchgear into circuit by driving, in a predetermined direction of rotation, both the engagement shaft and a large toothed wheel mounted on the engagement shaft together with a small toothed wheel which meshes with said large toothed wheel and which is coupled to a drive member for putting the engagement spring under stress so that the engagement spring can put the switchgear into circuit, said drive member operating by driving said engagement shaft and said large toothed wheel via said small toothed wheel in said predetermined direction, said engagement shaft being adapted to pass from a position in which the engagement spring is at least partially relaxed to beyond a dead-center position in which the engagement spring is under stress, said large toothed wheel including a periphery and teeth, said small toothed wheel including teeth;

a gap formed in the periphery of said large toothed wheel and generated by a discontinuity in the teeth of said large toothed wheel; and a retractable tooth on the large toothed wheel, said retractable tooth having a shape which includes flanks meeting radially outwards at a common edge and a sloping plane in a top zone adjacent to the common edge, said retractable tooth being axially retractable against a biasing force of a compression spring such that said retractable tooth is movable between a non-retracted state and a retracted state;

wherein said gap formed in the periphery of said large toothed wheel is followed, in said predetermined direction, by said retractable tooth, and wherein said retractable tooth is followed in said predetermined direction by an additional gap formed at the periphery of said large toothed wheel, and generated by an additional discontinuity in the teeth of said large toothed wheel, said additional gap extending over at least two meshing steps.

7. A mechanism according to claim 6, further comprising a pawl mechanism adapted to bear against the large toothed wheel in a bearing position situated beyond the dead-center position in said predetermined direction and to release said engagement shaft to put the switchgear into circuit;

wherein said gap is provided in a zone of the teeth of said large toothed wheel which is situated close to said small toothed wheel when said engagement shaft is bearing against the pawl mechanism.

8. A mechanism according to claim 7, wherein the teeth of said small toothed wheel are each shaped to have flanks that meet radially outwards on a common edge and present, on a leading flank, an involute shape and on an opposite flank, a flank plane extending from the common edge and sloping relative to a radial straight line passing through the middle of the tooth.

9. A mechanism according to claim 6, wherein the teeth of said small toothed wheel are each shaped to have flanks that meet radially outwards on a common edge and present, on a leading flank, an involute shape and on an opposite flank, a flank plane extending from the common edge and sloping relative to a radial straight line passing through the middle of the tooth.

10. A mechanism according to claim 6, wherein a first tooth of the teeth of said large toothed wheel following the additional gap has a shape similar to that of the retractable tooth.

11. A mechanism according to claim 10, wherein at least one additional tooth beyond said first tooth following the additional gap of said large toothed wheel is of a shape similar to that of the retractable tooth.

12. A mechanism according to claim 6, wherein said additional gap extends over three meshing steps.

13. A mechanism according to claim 6, wherein said retractable tooth, when in the non-retracted state, stands proud relative to the teeth of the large toothed wheel other than said retractable tooth.

* * * * *